United States Patent [19]

Stahlecker

[11] Patent Number: 4,774,806

[45] Date of Patent: Oct. 4, 1988

[54] CONTROL MEANS FOR AN OPEN-END SPINNING MACHINE

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 143,297

[22] Filed: Jan. 11, 1988

Related U.S. Application Data

[63] Continuation of Ser. No. 900,692, Aug. 27, 1986, abandoned, which is a continuation of Ser. No. 674,916, Nov. 26, 1984, abandoned.

[30] Foreign Application Priority Data

Nov. 24, 1983 [DE] Fed. Rep. of Germany ..... 3342481

[51] Int. Cl.[4] ..... D01H 7/885

[52] U.S. Cl. ..... 57/264; 57/301; 57/401; 57/411

[58] Field of Search ..... 57/264, 300, 301, 400, 57/401, 5, 263, 403, 411, 415

[56] References Cited

U.S. PATENT DOCUMENTS

| | | | |
|---|---|---|---|
| 4,084,398 | 4/1978 | Stahlecker et al. | 57/264 X |
| 4,137,699 | 2/1979 | Stahlecker et al. | 57/264 |
| 4,155,217 | 5/1979 | Stahlecker | 57/304 |
| 4,202,163 | 5/1980 | Turk et al. | 57/401 |
| 4,209,778 | 6/1980 | Wehde et al. | 57/265 X |
| 4,222,224 | 9/1980 | Raasch | 57/301 X |
| 4,367,623 | 1/1983 | Parker et al. | 57/401 X |
| 4,380,892 | 4/1983 | Parker et al. | 57/301 X |
| 4,514,973 | 5/1985 | Stahlecker | 57/301 |
| 4,592,198 | 6/1986 | Stahlecker | 57/401 |

FOREIGN PATENT DOCUMENTS

| | | | |
|---|---|---|---|
| 109236 | 5/1984 | European Pat. Off. | 57/401 |

*Primary Examiner*—Stuart S. Levy
*Assistant Examiner*—Joseph J. Hail, III
*Attorney, Agent, or Firm*—Barnes & Thornburg

[57] ABSTRACT

Open end friction spinning apparatus is provided in which there are one or more spinning units with respectively two adjacently arranged rollers, rotating in the same direction, and disposed to form a wedge-shaped slot therebetween for accepting fibers and spinning them into a thread of yarn by means of a friction effect. Devices are provided for monitoring the friction effect and adjusting the friction effect when necessary in order to maintain uniform spinning conditions at the individual spinning units and thereby control the quality of yarn produced.

51 Claims, 5 Drawing Sheets

CONTROL MEANS FOR AN OPEN-END SPINNING MACHINE

This is a continuation of application Ser. No. 900,962, filed Aug. 27, 1986, which is a continuation of application Ser. No. 674,916, filed Nov. 26, 1984 both of which are now abandoned.

BACKGROUND AND SUMMARY OF THE INVENTION

The invention relates to an open-end friction spinning machine having a plurality of spinning units, each containing two rollers arranged next to one another and drivable in the same rotational direction. The two rollers are positioned so as to form a wedge-shaped gap in which, by means of a friction effect, yarn is formed from individual fibers fed to the gap. At least one roller is equipped with a suction insert connected to a vacuum source.

A primary objective of the invention is to design an open-end friction spinning machine of the above-mentioned type in such a way that the quality of the yarn spun at each individual spinning unit, as well as the relative quality among spinning units, is kept as uniform as possible throughout the duration of the operating time.

This objective is achieved in that means are provided for monitoring at least a part of the friction effect.

The invention is in this case based on the knowledge that spinning conditions and, thus, the yarn produced, are very dependent on the friction effect which is primarily affected by the coefficient of friction of the surfaces of the rollers and the vacuum of the suction insert or inserts acting in the wedge-shaped gap. Changes of this friction effect will immediately result in a change of the quality of the yarn and the structure of the yarn. By monitoring the friction effect according to the invention, it becomes possible to recognize these changes early and to take appropriate countermeasures so that a uniform quality of yarn can be maintained.

In order to be able to counteract the changing friction effect, means are provided in an advantageous aspect of the invention for adjusting at least part of the friction effect.

In a further development of the invention, means are provided for stopping a spinning unit which are controlled by the means used for the monitoring. The stopping prevents qualitatively useless yarn from being wound unto a spool. However, stopping will, as a rule, be useful only if the changes determined by monitoring are such that they cannot be eliminated simply by means for adjusting the friction effect.

In a first embodiment of the invention, each spinning unit is equipped with at least one vacuum supply means connected to a signal transmitter and/or to a device for stopping the spinning unit. Through these devices, that part of the friction effect is controlled that is caused by the suction insert or inserts. When the changes are so great that a qualitatively useless yarn is produced, it is advantageous to stop the problem spinning unit. However, when the changes are noticeable but do not result in an unacceptable lessening of the quality of the yarn, an operator or a servicing apparatus can be called via the then actuated signal transmitter for the purpose of carrying out an examination or an adjustment. It is advantageous to provide each spinning unit with a control valve having an adjusting element in the connection to the suction insert or inserts. Thus the desired vacuum can then be adjusted individually at the corresponding spinning unit.

In another advantageous aspect of the invention, the vacuum supply means of the spinning units is connected to a central evaluating circuit controlling means for adjusting the vacuum at an individual spinning unit and/or to means for interrupting the spinning operation of the individual spinning units. By means of this development, continuous monitoring of the individual spinning units is made possible. This, however, requires relatively high manufacturing expenditures.

In a further development of the invention, the means for monitoring and adjusting at least part of the friction effect of the rollers of a spinning unit and the means for stopping and/or marking a spinning unit are housed in a servicing apparatus that can be moved along the machine and applied to an individual spinning unit. In the case of this development of the invention, the necessary expenditures can be reduced considerably, but only a periodic monitoring of the individual spinning units is possible. Such periodic monitoring would be sufficient in a majority of cases because changes in the friction effect take place only after a certain length of operating time.

In a further development of the invention, means are provided for detecting the part of the friction effect of a spinning unit that is caused by the coefficient of friction of the surfaces of the rollers. This makes it possible to detect a significant part of the friction effect. The combination of monitoring of the vacuum and of detecting the coefficient of friction results in particularly reliable monitoring. The change of the coefficient of friction of the surfaces of the rollers can take place as the result of deposits but also as a result of wear of the surface structure of the rollers.

In an advantageous development, means for conditioning the surfaces of the rollers are provided which are controlled by the means for detecting the coefficient of friction of the surfaces. These means for conditioning, which may cause cleaning and/or treating and/or coating of the surfaces of the rollers, have the purpose of restoring the desired surface structure and, thus, the desired coefficients of friction. In this manner, uniform spinning conditions are maintained.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
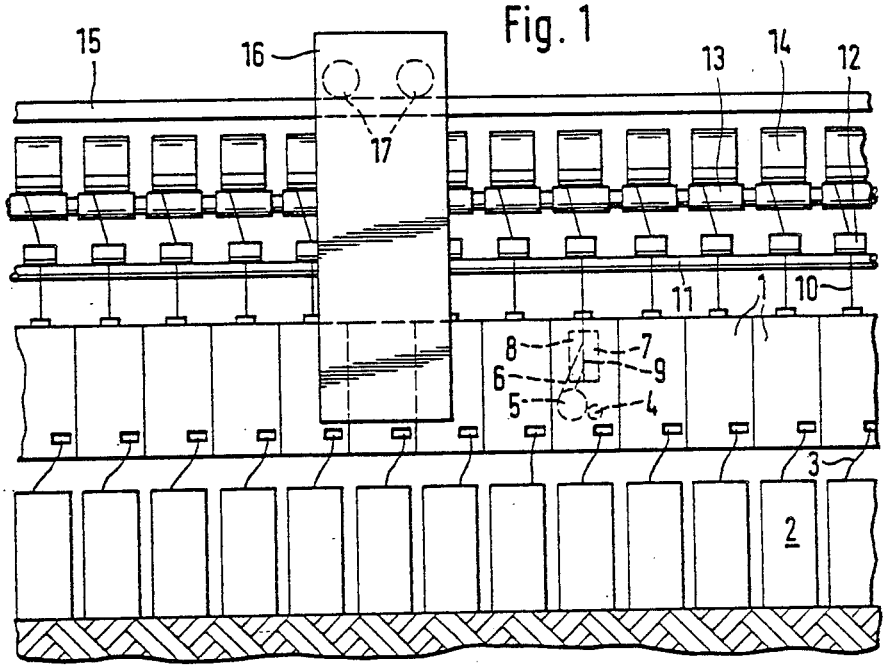
FIG. 1 is a partial front view of an open-end friction spinning machine with a movable servicing apparatus, constructed in accordance with a preferred embodiment of the invention.

The open-end friction spinning machine according to FIG. 1 has a plurality of spinning units that are arranged next to one another and are similar to one another. A sliver 3 to be spun is fed to each of these spinning units 1 from a can 2. The feeding of the sliver 3 takes place by means of a feeding roller 4 which usually interacts with a feeding table and which offers the sliver 3 to a rapidly turning opening roller 5. Roller 5 is equipped at its circumference with a set of needles or teeth which opens up the sliver 3 into individual fibers. The individual fibers are conveyed via a fiber feeding duct 6 to two rollers 7 and 8 arranged next to one another and drivable in the same rotational direction. These rollers together form a wedge-shaped gap 9 where the forming of the yarn takes place. The yarn 10 which is twisted together because of a friction effect in the wedge-shape gap 9 is withdrawn in the direction of the wedge-shaped gap 9 by means of a withdrawal device. This device is formed by a driven withdrawal cylinder 11 running in the longitudinal direction of the machine and one pressure roller 12 applied respectively to each spinning unit. The withdrawn yarn 10 is wound onto a wind-up spool 14 driven by a grooved drum 13.

Rails 15 are arranged along the open-end friction spinning machine on which the servicing apparatus or unit 16 can be moved by means of running wheels 17. The servicing apparatus 16 may, for example, be equipped with means for carrying out a yarn piecing process after yarn breakage. Apparatus 16 may also be provided with means for carrying out a spool change at the individual spinning units 1. It can be applied to each spinning unit 1. This servicing apparatus 16 may also be equipped with means hereafter described for carrying out a performance test at the spinning units 1. It may alternately be provided that the servicing apparatus 16 contains only the means hereafter described for carrying out the performance tests at the individual spinning units. Appartus 16 may, therefore, be provided as an inspection carriage which may be used independently of the other servicing apparatuses used for yarn piecing or for changing of spools.

Figure 2:
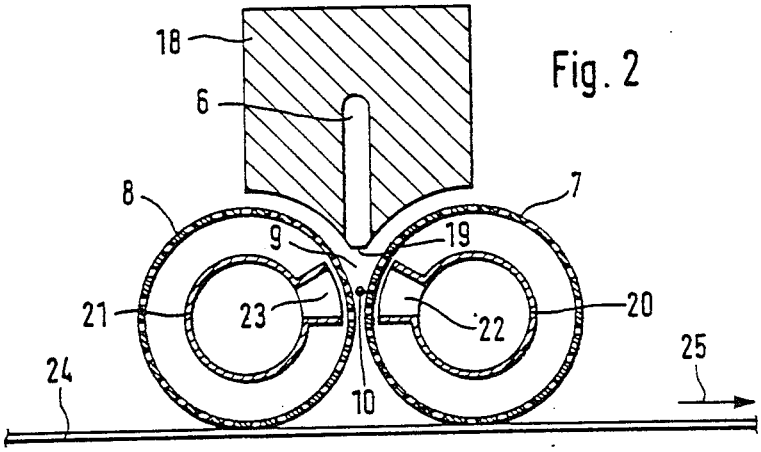
FIG. 2 is an enlarged cross sectional view of a spinning unit of the open-end friction machine of the type to which the present invention relates.

Referring to FIG. 2, the rollers 7 and 8 of a spinning unit comprise perforated shells which, by means of roller bearings 26 and 27 (shown in FIG. 3) are disposed on tube-shaped suction inserts 20 and 21. The suction inserts 20 and 21 have slot-shaped suction openings 22 and 23 which are delimited by webs arranged closely to the inside surfaces of the shells. These suction openings are aimed at the wedge-shaped gap 9. Suction inserts 20 and 21 which project beyond the front ends of the rollers 7 and 8 are clamped tightly at at least one side to bearing housing 28 by means of tool holders 29 and screws 30. One end of the suction inserts 20 and 21 is closed by a plug 31, while the other end, via a T-shaped branching 32, is connected to a vacuum pipe 33. In the vacuum pipe 33, behind the branching 32, a control valve 34 is arranged. This control valve is provided with an adjusting element 35 by means of which the vacuum in the suction inserts 20 and 21 can be adjusted to the proper value. The area of the wedge-shaped gap 9 of the two rollers 7 and 8 (FIG. 2) is covered by a preferably removable housing part 18 containing the mouth 19 of the fiber feeding duct 6. This fiber feeding duct 6 connects the feeding and opening device 4, 5 with the wedge-shaped gap 9. The mouth 19 of the slot-shaped fiber feeding duct extends longitudinally in a certain portion of the wedge-shaped gap 9. The mouth 19 forms the so-called scatter zone where feeding of the individual fibers takes place. By means of the vacuum applied to the suction inserts 20 and 21, a suction is caused through the perforations of the rollers 7 and 8 which ensures that the individual fibers are transported into the area of the wedge-shaped gap 9 and that the forming yarn 10 is kept in this area. The two rollers 7 and 8 are driven in the same rotational direction by means of a tangential belt 24 running along in contact with the machine as indicated by the Arrow 25, which belt 24 drives all rollers 7 and 8 of the spinning units 1 of one side of the machine.

The twisting together of the fibers into yarn 10 takes place bacause of the friction effect in the area of the wedge-shaped gap 9. The friction effect is produced by both the friction forces of the roller surfaces and the air flow directed into the suction inserts 20 and 21. The invention also contemplates designs where only one roller is a suction roller. The other roller may then have a closed profiled shell cover surface or a surface with a coating.

Figure 3:
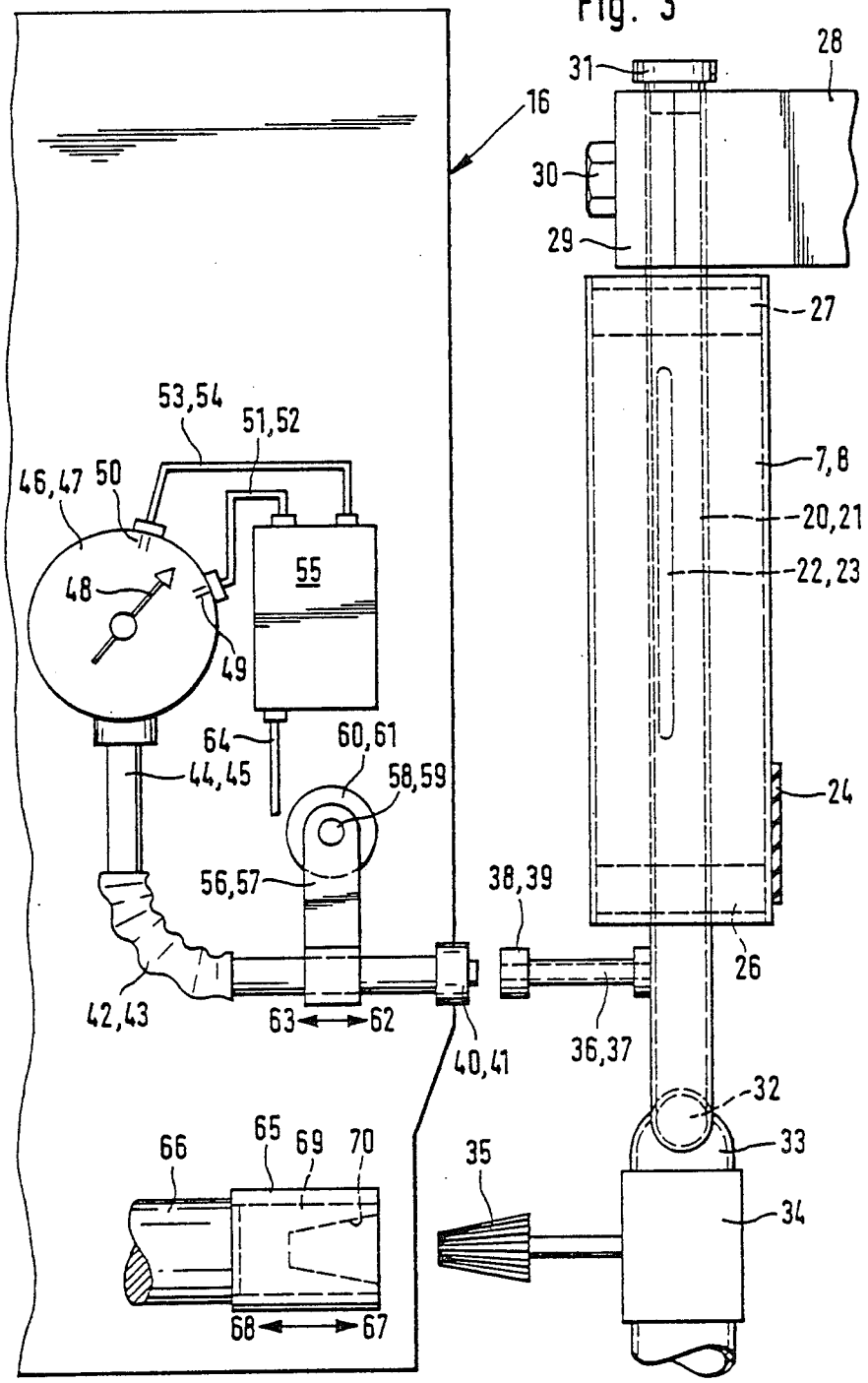
FIG. 3 is a diagrammatic representation of a lateral view of a spinning unit and a servicing apparatus constructed in accordance with a preferred emodiment of the invention, by means of which monitoring of the vacuum of the suction inserts as well as adjustment of the vacuum is possible.

The two suction inserts 20 and 21 are each provided with their own connection 36 and 37 leading to couplings 38 and 39 which are provided with a closing element that is not shown. Coupling 40 and 41 of the servicing apparatus 16 may be connected to the couplings 38 and 39. The couplings 40 and 41, when moved in the direction of the Arrow 62, open the closing elements of the couplings 38 and 39. The couplings 40 and 41 are held by holders 56 and 57 that are pivotal around shafts 58 and 59 by means of one or two motor operators 60 and 61. By pivoting of shafts 58 and 59, couplings 40 and 41 can be caused to engage or disengage couplings 38 and 39. The coupling pieces 40 and 41, via hoses 42 and 43, are connected to the inlets 44 and 45 of vacuum measuring means 46 and 47. These vacuum measuring means are shown in FIG. 3 in diagram form as a type of manometer provided with an index hand 48. After the couplings 40 and 41 are engaged, the vacuum measuring means 46 and 47 monitor the vacuum existing in suction inserts 20 and 21. For this purpose, the spinning unit 1 does not have to be opened and the spinning process does not have to be interrupted.

The vacuum measuring means 46 and 47 supply signals to an evaluating circuit 55. It is shown by means of example that the vacuum measuring means 46 and 47 are adjusted to an upper limiting value 50 and a lower limiting value 49 which determine the desired vacuum range within the suction inserts 20 and 21. The limiting value indicators 49 and 50, via lines 51, 52 and 53, 54, are connected to the evaluating circuit 55. The servicing apparatus 16 is also supplied with an actuating element 65 which, upon movement in corresponding to the direction of the Arrow 67, is engaged with a rotatable adjusting element 35 of a control valve 34. The adjusting element 35 consists of a cone onto which a complimentary conical recess 70 of the coupling part 69 of the actuating element 65 can be fitted in such a way that a connection is obtained. The actuating element 65 is arranged on a shaft 66 which can be driven sensitively in both rotational directions by means of a motor operator that is not shown. The drive of the shaft 66 is controlled via the evaluating circuit 55 which via a line 64 is connected with a motor operator associated with the shaft 66.

After the couplings 40 and 41 are engaged with the couplings 38 and 39, the vacuum existing in the suction inserts 20 and 21 is monitored by the vacuum measuring means 46 and 47 and the evaluating circuit 55. If the vacuums are within the permissible tolerance range, the couplings 40 and 41 are withdrawn in the direction of the Arrow 63. The servicing apparatus 16 will then proceed with its monitoring program. If it is determined, however, that the vacuum existing in the suction inserts 20 and 21 deviate from the desired values, the evaluating circuit 55 initiates an intervention into the spinning unit 1. If it is determined, for example, that the existing vacuums unacceptably deviate from the desired values but also unacceptably differ with respect to each other, the evaluating circuit causes a stoppage of the spinning unit. This may be done, for example, by applying a blade to the moving yarn of the spinning unit 1 causing a yarn breakage which automatically causes a stoppage of the spinning unit 1. A yarn guard associated with the moving yarn of the spinning unit 1 stops the feeding roller 4 and, thus, interrupts the feeding of fibers. It is probable in this case that the relative deviation of the measured vacuums in the suction inserts 20 and 21 from one another is an indication of the fact that one of the suction inserts 20 or 21 or the respective roller 7 or 8 are clogged by deposits. The spinning unit 1 can resume operation by yarn piecing only when a corresponding cleaning has taken place. The means for cleaning may be housed in a movable yarn piecing device. However, it may also be provided that the means for cleaning are integrated into the servicing apparatus 16 according to certain preferred embodiments of the invention. In another advantageous aspect, a separate cleaning device is called to a respective spinning unit 1 because the evaluating circuit 55 sends a signal regarding the spinning unit 1 to be cleaned.

When the evaluating circuit 55 determines that the vacuums in the suction inserts 20 and 21 deviate from one another in a way that is acceptable but differs from the desired value, the actuating member 65 for the actuating element 35 of the control valve is actuated. The control valve 34 is then adjusted in such a way that the desired value for the vacuum is again attained in the suction inserts 20 and 21.

As mentioned before, the elements of the servicing apparatus 16 are shown only in diagram form. Only one of the vacuum measuring means 46 or 47 to which both coupling pieces 40 and 41 are connected may be employed, in which case a switching valve will then be arranged in this connection so that a reversal can take place from the common vacuum measuring means 46 or 47 to monitoring of the desired suction insert 20 and 21. It may advantageously be provided that the evaluating circuit 55 also quantitatively evaluates a joint deviation of the vacuums in the suction inserts 20 and 21 and includes the amount of the deviation in the decision as to which corrective action must be carried out. When the quantitative deviation of the vacuums in the suction inserts 20 and 21 from the desired values exceeds an indicated value, this is also an indication of the fact that the suction inserts 20 and 21 or the perforations of the respective rollers 7 and 8 are clogged by deposits. In this case, the spinning unit 1 will be stopped.

The use of a movable servicing apparatus 16 for checking the vacuums in the suctions inserts 20 and 21 has the advantage that the required devices need be provided only in the servicing apparatus 16 and not at each spinning unit 1. It is naturally also possible to do without such a servicing apparatus 16, and to then mount vacuum measuring means connected to the suction inserts 20 and 21 of each spinning unit 1 instead of the connecting pieces 38 and 39. These may, for example, be manometers which can then be monitored by the operator who corresponding to the above-mentioned criteria, will then carry out the same activities which the servicing apparatus 16 carries out automatically. The vacuum measuring means applied to each spinning unit 1 may be designed in such a way that they automatically stop the spinning unit 1 when deviations from the desired values are determined. For example, feeding of the sliver can be interrupted by automatic actuation of a stop switch.

It is also possible to equip each spinning unit with vacuum measuring means in the suction inserts 20 and 21 which are connected to a central evaluating circuit of the open-end friction spinning machine. This evaluating circuit can then test the individual spinning units in an indicated sequence. It is advantageous to then provide each spinning unit with its own control element for the control valve 34 which can be controlled via the evaluating circuit. In the same way, the evaluating circuit could then be equipped with means for stopping the concerned spinning unit.

The monitoring disclosed aboved is based on the fact that a checking of that part of the friction effect that is caused by the vacuum in the suction inserts 20 and 21 is carried out without interrupting the operation of the spinning units 1. However, this checking may be carried out when the spinning unit is open, for example, after a yarn breakage or due to another servicing process. A testing head may be applied to the open spinning unit 1 in the area of the wedge-shaped gap 9. This head could, for example, have the shape of the partial housing 18 in FIG. 2 and be provided with a mouth of a duct that corresponds to the mouth 19 of the fiber feeding duct 6, a vacuum measuring means or a device for measuring the air flow through the mouth. Such a testing head may advantageously be arranged in a movable yarn piecing device, and then applied to the wedge-shaped gap 9 before a yarn piecing process is carried out in order to check before the piecing process whether the desired conditions exist at this spinning unit.

Figure 4:
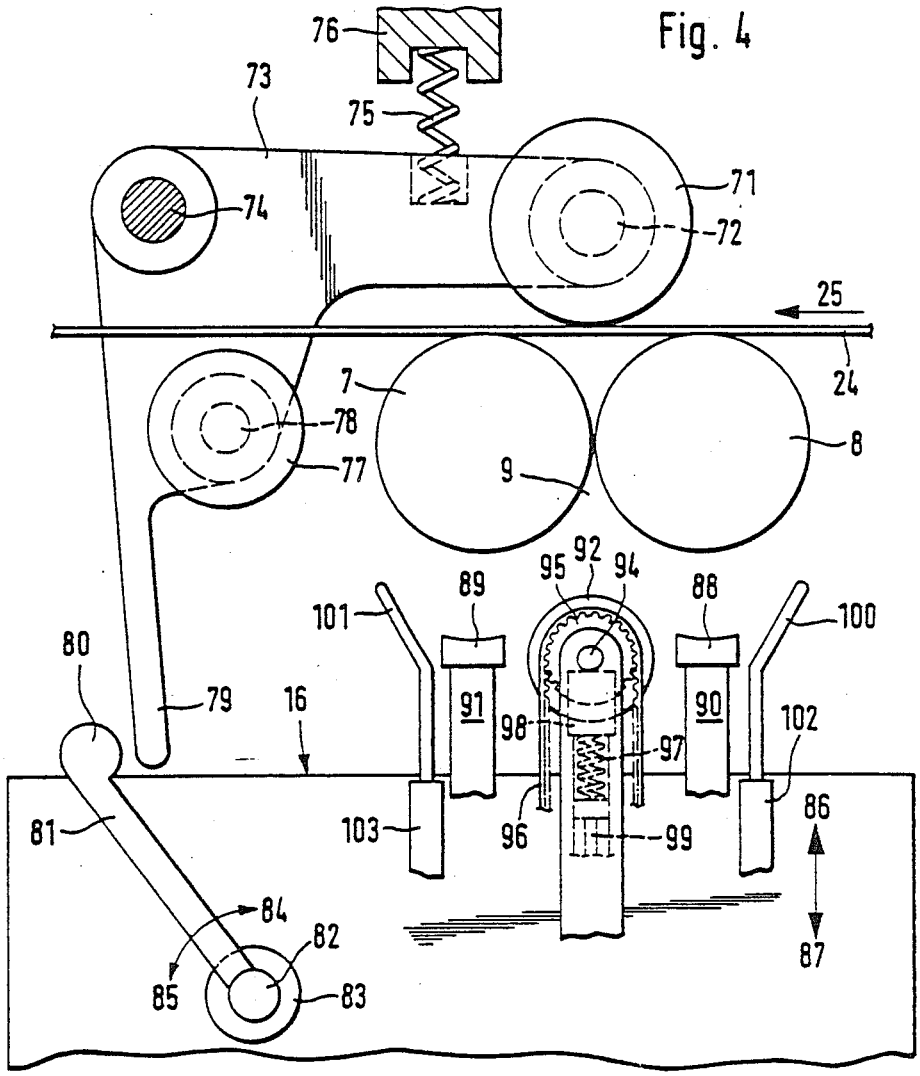
FIG. 4 is a diagrammatic top view of a spinning unit with a servicing apparatus having means for monitoring the coefficients of friction of the rollers and means for conditioning these surfaces, constructed in accordance with another preferred embodiment of the invention.

In the following, it is shown by means of FIG. 4 that the movable servicing apparatus 16 is also equipped with means for examining and adjusting that part of the friction effect that is caused by the condition of the surfaces of the rollers 7 and 8, i.e. their coefficients of friction. Alternatively, these means may be housed in other servicing apparatuses, especially in a yarn piecing device. In FIG. 4 it is also shown that these means are applied between the rollers 7 and 8 in the area of the wedge-shaped gap 9, while the spinning unit is stopped. However, it is further contemplated to house these means or similar means in a movable servicing apparatus 16 in such a way that they can be applied to the turning rollers 7 and 8 without interrupting the spinning operation. For this purpose, it is, for example, contemplated to apply corresponding means to the surfaces of the rollers 7 and 8 adjacent to the housing part 18 (FIG. 2).

The spinning unit shown in FIG. 4 is equipped with a device for interrupting the operational drive, wherein a tangential drive belt 24 is lifted off the surfaces of the rollers 7 and 8. Each spinning unit is provided with a pivotal lever 73 which can be pivoted around a shaft 74 that is parallel to the shafts of the rollers 7 and 8 and which carries a tension pulley 71 which can be rotated around a shaft 72 that is parallel to the pivotal shaft 74. The tension pulley 71 is located on the side of the tangential belt 24 opposite the rollers 7 and 8. The axis of rotation of the tension pulley is contained in a plane cotangent to the rollers 7 and 8, said plane bisecting the wedge-shaped gap 9 formed by rollers 7 and 8. By means of this arrangement, the tangential belt 24 is pressed uniformly against the shells of the two rollers 7 and 8. A pressure spring 75 contacts the pivotal lever 73 which presses the tension pulley 71 against the tangential belt 24. The pressure spring 75 supports itself on stationary holding means 76. On the side of the rollers 7 and 8, a lift-off roll 77 is arranged at the pivotal lever 73 which can be rotated around a shaft 78. The pivotal lever 73 is also provided with an arm 79 which projects out of the spinning unit 1 to the operator's side of the machine on which the servicing apparatus 16 can be moved. An actuating lever 81 equipped with a thrust piece 80 is arranged opposite the arm 79. The actuating lever 81 is pivotal with respect to a shaft 82 in the direction of the Arrows 84 and 85 by means of a motor operator 83. When the actuating lever 81 is pivoted in the direction of the Arrow 84, the pivotal lever 73 of the spinning unit 1 is pivoted in such a way that the tension pulley 71 is removed from the tangential belt 24, while the belt 24, by means of the lift-off roll 77, is lifted off the surfaces of the rollers 7 and 8. In this way, the drive of the rollers 7 and 8 can be disengaged and reengaged when the actuating lever 81 is pivoted back (in the direction of the Arrow 85).

The servicing apparatus 16 contains other elements which each can be applied to the rollers 7 and 8 in the direction of the arrow 86 and which can be lifted off the rollers 7 and 8 again in the direction of the arrow 87. Two brake blocks 88 and 89 are arranged on pressure rods 90 and 91 that can be extended from the servicing apparatus 16. The pressure rods 90 and 91, by means of determinable force, press the brake blocks 88 and 89 onto the surfaces of the rollers 7 and 8 on which the tangential belt 24 runs along. In the area of the wedge-shaped gap 8, a friction wheel 92 is then applied to the surfaces of the rollers 7 and 8, the shaft 94 of which extends in parallel to the shafts of the rollers 7 and 8. The friction wheel 92 is applied in the area of the surfaces of the rollers 7 and 8 which is usually opposite the mouth 19 (FIG. 2) of the fiber feeding duct. If required, separate friction wheels 92 are applied to each of the rollers 7 and 8. This is required especially if the coefficients of friction of both rollers 7 and 8 should differ from one another, as for example, in the case where only one of the two rollers 7 and 8 is designed as a suction roller. The friction roller, with its shaft 94, is arranged on a rod 93 that can be extended, and is connected in a rotatably stable manner with a toothed wheel 95. By means of a toothed belt 96, the toothed wheel is driven by a driving motor that is not shown. After it is applied to the rollers 7 and 8, the friction roller 92, by means of a pressure spring 97 and a thrust piece 98, is pressed against the rollers 7 and 8 with a measurable force. The force of the springs is adjusted and measured via a piston cylinder unit 99. Then the friction roller 92 is driven with increasing torque. The torque required to turn the rollers 7 and 8 against the effects of the brake blocks 88 and 89 is measured. This supplies a measurement for the existing coefficients of friction of the rollers 7 and 8. The derived coefficient of friction is compared to desired value by means of an evaluating circuit that is not shown. In the case of unacceptable deviations from the desired value, the evaluating circuit initiates corrective treatment of the surfaces of the rollers 7 and 8. This takes place, for example, by application of elastic surfaces 100 and 101 arranged on rods 102 and 103 to the surfaces of rollers 7 and 8 in the area that comes in contact with the fibers. The elastic surfaces, on their sides facing the rollers 7 and 8, may be provided with a friction lining or similar means. The described means have the advantage that slight operational speed differences of the rollers of the individual spinning units have no effect because prior to the torque measurement, rollers 7 and 8 are stopped by the brake blocks 88 and 89.

Figure 6:
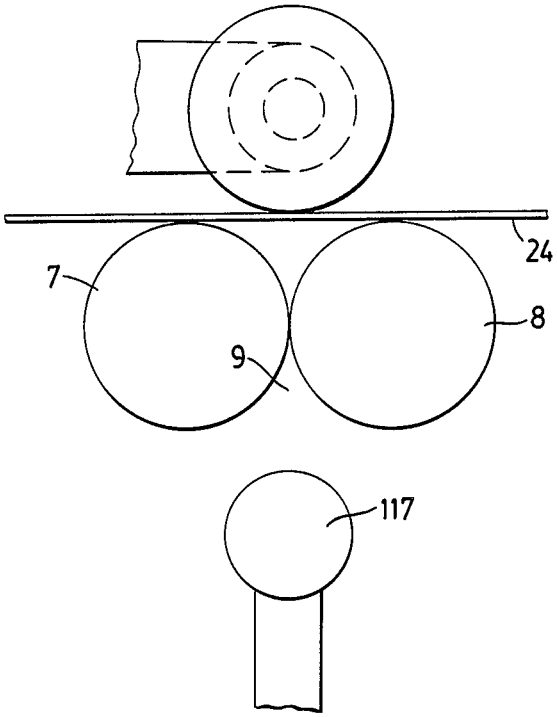
FIG. 6 is a schematic view of a device for monitoring the coefficient of friction of the surfaces of the rollers in accordance with another preferred embodiment of the invention.

It is further contemplated to supply other means 117 for detecting the coefficient of friction, such as friction elements placed against the circumferential surfaces of the rollers 7 and 8 (FIG. 6). Tangential forces applied on these friction elements are then measured. In this case, the rollers 7 and 8 may remain connected to their operational drive, the tangential belt 24. In this way, measurements may be taken without opening the spinning units and interrupting the spinning operation.

For the corrective treatment of the surfaces of the rollers 7 and 8, the use of a variety of devices is contemplated, such as brushes that roughen up the surfaces, treatment strips, scraper-type plastic elements, elements which coat the surfaces of the rollers, or similar devices.

Figure 5:
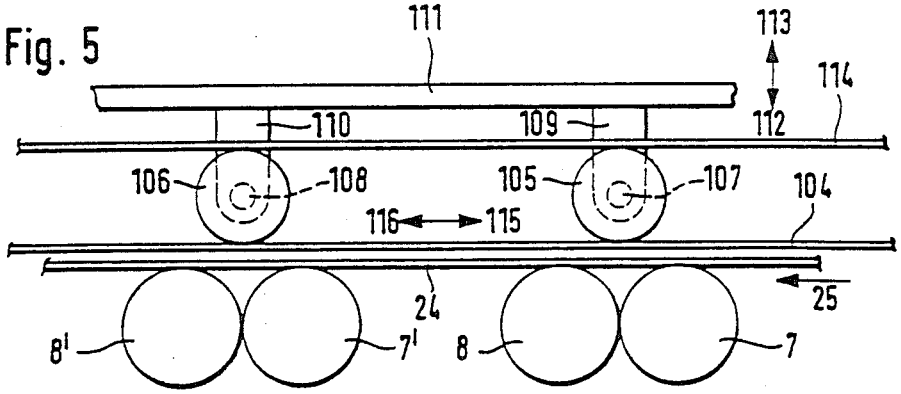
FIG. 5 is a diagrammatic top view of two spinning units having means for conditioning the surfaces of the rollers forming a component of the spinning machine utilizing a preferred embodiment of the present invention.

As shown in FIG. 5, the means for corrective treatment may be a component of the open-end friction spinning machine itself which will be actuated when needed and particularly after the servicing apparatus 16 has determined that corrective treatment is necessary due to an unacceptable deviation in the coefficients of friction. FIG. 5 shows the rollers 7 and 8 as well as 7' and 8' of two adjacent spinning units which are driven by a tangential belt 24. In the area of the fiber-carrying surfaces of the rollers 7 and 8 as well as 7' and 8', a treatment belt 104 runs in the longitudinal direction of the machine. This treatment belt extends over several spinning units and may extend over one whole side of the machine. The treatment belt 104, in the area of each spinning unit 1, is guided by means of pulleys 105 and 106 which, by means of shafts 107 and 108, are arranged in the plane of the wedge-shaped gap on holders 109 and 110. The returning end 114 of the belt is also guided on the rollers 105 and 106. The holders 109 and 110 are mounted at a rail 111 extending in longitudinal direction relative to the machine. Corresponding to the directions of the Arrows 112 and 113, the rail can be adjusted in such a way that the treatment belt 104 which is normally at a distance from the rollers 7 and 8 as well as 7' and 8' is applied to the rollers 7, 8 and 7', 8'. In this way, if required, all rollers 7 and 8 of all spinning units can be correctively treated in the same manner through the use of the same treatment means, namely the treatment belt, on all spinning units. The treatment belt 104 can rotate at a low running speed or it may be driven to perform a changing movement corresponding to the Arrows 115 and 116.

The application of the treatment belt 104 to the rollers 7 and 8 is controlled by the servicing apparatus when it determines unacceptable coefficients of friction at one or more spinning units. In this case, the servicing apparatus may initiate the application of the belt, for example, by adjusting a lever in the area of the headstock of the friction spinning machine.

It is also contemplated to arrange the rail 111 in a stationary manner and to design the individual holders 109 and 110 of the individual spinning units so that they can be moved back and forth corresponding to the Arrows 112 and 113. The treatment belt 104, the width of which corresponds at least to the length of the mouth 19 of the fiber feeding duct 6 (FIG. 2) can then be applied to the rollers 7 and 8 of the individual spinning units 1 when required by the servicing apparatus 16.

Figure 7:
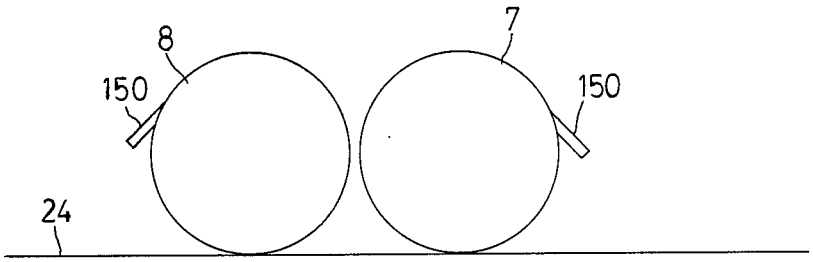
FIG. 7 is a schematic view of a conditioning device for coating the surfaces of the rollers.

FIG. 7 schematically shows a conditioning element 150 for applying a coating to the friction rollers 7,8.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open-end friction spinning apparatus comprising:

a plurality of spinning units, each of which contain movable friction surface means forming a yarn forming region wherein yarn is formed from fibers by means of a friction effect at the friction surface means, said friction effect being composed of suction effect and friction surface means surface coefficient of friction effect, friction effect monitoring means for directly monitoring said friction effect in the yarn forming region other than by measuring the condition of formed yarn, said monitoring means including means for directly monitoring at least one of the suction effect in the yarn formation zone and the friction surface means surface coefficient of friction effect, friction effect adjusting means for adjusting said friction effect, said adjusting means including means for adjusting at least one of the suction effect in the yarn formation zone and the friction surface means surface coefficient of friction effect, said adjusting means being responsive to changes in friction effect monitored by said monitoring means, and a mobile servicing apparatus selectively movable to said spinning units for servicing operations, said mobile servicing unit carrying at least part of at least one of the friction effect monitoring means and the friction effect adjusting means.

2. Apparatus according to claim 1, wherein said movable friction surface means comprises:

a pair of adjacently arranged friction rollers forming a wedge-shaped yarn forming gap therebetween wherein yarn is formed from fibers by means of a friction effect at the surfaces of the rollers.

3. Apparatus according to claim 2 wherein at least one of said friction rollers is equipped with suction insert means connected to a vacuum source, said friction effect monitoring means including vacuum monitoring means for monitoring the vacuum in said suction insert means.

4. Apparatus according to claim 3, wherein said vacuum monitoring means comprises vacuum measuring means, coupling means for coupling said vacuum measuring means to said suction insert means, control means for controlling said vacuum in said suction insert means, and evaluating circuit means for receiving signals from said vacuum measuring means and transmitting signals to said control means.

5. Apparatus according to claim 4, wherein stopping means are provided for stopping a spinning unit, said stopping means being actuated by signals received from said vacuum measuring means.

6. Apparatus according to claim 4, wherein said evaluating circuit means actuates stopping means for stopping a spinning unit.

7. Apparatus according to claim 4, wherein said vacuum monitoring means are housed in said movable servicing apparatus, said movable servicing apparatus being capable of monitoring at least part of said friction effect of at least one said spinning unit.

8. Apparatus according to claim 7, wherein each spinning unit has a removable housing part covering said wedge-shaped gap and said servicing apparatus has insertable testing head means for measuring air flow in the area of said wedge-shaped gap upon removal of said housing part and insertion of said testing head means into said wedge-shaped gap.

9. Apparatus according to claim 8, wherein said suction insert means is equipped with control valve means, said servicing apparatus having actuating means for actuating said control valve means.

10. Apparatus according to claim 3, wherein said adjusting means comprising adjusting valve means for controlling said vacuum source.

11. Apparatus according to claim 3, wherein said vacuum monitoring means are housed in said movable servicing apparatus capable of monitoring at least part of said friction effect.

12. Apparatus according to claim 2, wherein said monitoring means comprises coefficient of friction measuring means for measuring the coefficient of friction of the surface of at least one of said rollers.

13. Apparatus according to claim 12, wherein said coefficient of friction measuring means comprises extendable rod means, friction wheel means rotatably mounted on said extendable rod means for contacting said roller surface, driving means for rotating said friction wheel means, spring means for forcing said friction wheel means into contact with the surface of at least one of the rollers, brake means for preventing rotation of at least one of the rollers, and torque measuring means for measuring the torque which must be supplied by said driving means to effect rotation of said at least one of the rollers after application of said brake means to said at least one of the rollers.

14. Apparatus according to claim 13, wherein stopping means are provided for stopping a spinning unit, said stopping means being actuated by signals received from said torque measuring means.

15. Apparatus according to claim 13, wherein said movable servicing apparatus is capable of actuating said coefficient of friction measuring means.

16. Apparatus according to claim 2, wherein said monitoring means comprises both vacuum monitoring means for monitoring a vacuum in said suction insert means and coefficient of friction measuring means for measuring the coefficient of friction of said surface of at least one of said rollers.

17. Apparatus according to claim 2, wherein said adjusting means comprises elastic surface means for conditioning the surface of at least one of said rollers.

18. Apparatus according to claim 17, wherein said movable servicing apparatus is capable of actuating said elastic surface means for conditioning said surface of at least one of the rollers.

19. Apparatus according to claim 2, wherein said adjusting means comprises treatment belt means for treating the surface of at least one of said rollers.

20. Apparatus according to claim 19, wherein said movable servicing apparatus is capable of actuating said treatment belt means for treating a surface of at least one of said rollers.

21. Apparatus according to claim 2, wherein stopping means are provided for stopping a spinning unit, said stopping means being actuated by signals received from said monitoring means.

22. Apparatus as in claim 2, wherein each of said pair of friction rollers is equipped with suction insert means connected to a vacuum source, said friction effect monitoring means including vacuum monitoring means for monitoring the vacuum separately in each of said pair of friction rollers.

23. An apparatus according to claim 1, including stopping means for interrupting operation of a spinning unit in response to monitoring of a changed friction effect.

24. An apparatus according to claim 1, wherein said monitoring means includes means for monitoring pressure within said friction surface means.

25. An apparatus according to claim 24, wherein said monitoring means includes means for automatically monitoring the pressure within said friction surface means, and wherein said friction effect adjusting means includes means for automatically adjusting said friction effect in response to a changed pressure within said friction surface means.

26. An apparatus according to claim 25, wherein said means for automatically adjusting said friction effect includes means for adjusting the pressure within said friction surface means.

27. An apparatus according to claim 26, wherein said means for adjusting the pressure within said friction surface means includes a control valve operable by an automatic servicing unit which is selectively movable to respective ones of said spinning units.

28. Apparatus as in claim 24, wherein each of said spinning units includes at least two friction surface means, said monitoring means including means for separately monitoring pressure within each of said friction surface means.

29. Apparatus as in claim 28, wherein said friction effect adjusting means includes means for automatically adjusting said friction effect in response to a changed pressure within said friction surface means.

30. Open-end friction spinning apparatus comprising:

a plurality of spinning units, each of which contain movable friction surface means forming a yarn forming region wherein yarn is formed from fibers by means of a friction effect at the friction surface means, said friction effect being composed of suction effect and friction surface means surface coefficient of friction effect, friction effect monitoring means for directly monitoring said friction effect in the yarn forming region, said monitoring means including means for directly monitoring at least one of the suction effect in the yarn formation zone and the friction surface means surface coefficient of friction effect, friction effect adjusting means for adjusting said friction effect, said adjusting means including means for adjusting at least one of the suction effect in the yarn formation zone and the friction surface means surface coefficient of friction effect, said adjusting means being responsive to a changed friction monitored by said monitoring means, and a movable servicing apparatus, said means for monitoring the suction effect in the yarn formation zone being disposed on the movable servicing apparatus, said servicing apparatus being capable of monitoring at least part of said friction effect of at least one said spinning unit, said means for adjusting the suction effect in the yarn formation zone being disposed on the movable servicing apparatus.

31. Apparatus according to claim 30, wherein said means for monitoring the suction effect in the yarn formation zone includes means for monitoring pressure within said friction surface means.

32. Open-end friction spinning apparatus comprising:

at least one spinning unit, each said spinning unit containing movable friction surface means forming a yarn forming region wherein yarn is formed from fibers by means of a friction effect at the friction surface means, said friction surface means including a first end area where fibers are delivered and including a second end area downstream in a yarn forming direction from said first end area, said second end area including a yarn withdrawal point where formed yarn is removed from said friction surface means;

at least one friction surface conditioning means for adjusting a coefficient of friction of said friction surface means, and friction surface monitoring means disposed on said friction surface means in an area upstream from said yarn withdrawal point for directly monitoring friction characteristics of said friction surface means.

33. Apparatus according to claim 32, wherein said conditioning means is responsive to a friction condition monitored by said monitoring means.

34. Apparatus according to claim 32, wherein said drivable friction surface means comprises adjacently arranged first and second friction rollers driven in the same rotational direction and said yarn formation zone comprises a wedge-shaped gap between said friction rollers.

35. Open-end friction spinning apparatus including at least one spinning unit having a yarn formation zone adjacent drivable friction surface means comprising:

at least one friction surface conditioning means for conditioning said friction surface means, and friction surface monitoring means for directly monitoring friction characteristics of said friction surface means, said friction surface monitoring means including measuring means for measuring a frictional force applied to said friction surface monitoring means by said friction surface means.

36. Apparatus according to claim 35, wherein said friction surface monitoring means further includes monitoring roller means, said measuring means measuring a frictional force applied to said monitoring roller means by said friction surface means.

37. Apparatus according to claim 36, wherein said drivable friction surface means comprises adjacently arranged first and second friction rollers driven in the same rotational direction and said yarn formation zone comprises a wedge-shaped gap between said friction rollers.

38. Apparatus according to claim 36, wherein said measuring means comprises mechanical measuring means for measuring a frictional force applied to said monitoring roller means by said friction surface means.

39. Apparatus according to claim 36, wherein said conditioning means is responsive to a friction condition monitored by said monitoring means.

40. An open-end friction spinning apparatus according to claim 34, further comprising adjustably movable servicing means capable of being disposed adjacent said at least one spinning unit, said friction surface monitoring means being attached to said servicing means.

41. An open-end friction spinning apparatus according to claim 36, comprising a plurality of said spinning units.

42. An apparatus according to claim 36, wherein auxiliary drive means are provided for driving said friction surface means during monitoring of said friction characteristics.

43. An apparatus according to claim 36, wherein said conditioning means includes coating means for applying coating onto said surface of said friction surface means.

44. Open-end friction spinning apparatus comprising:

a plurality of spinning units, each of which contain a pair of adjacently arranged friction rollers forming a wedge-shaped yarn forming gap therebetween wherein yarn is formed from fibers by means of a friction effect at the surfaces of the rollers, at least one roller of each pair being equipped with suction insert means connected to a vacuum source, friction effect monitoring means including vacuum monitoring means for monitoring the vacuum in said suction insert means, said vacuum monitoring means including vacuum measuring means, coupling means for coupling said vacuum measuring means to said suction insert means, control means for controlling said vacuum in said suction insert means, and evaluating circuit means for receiving signals from said vacuum measuring means and transmitting signals to said control means, a movable servicing apparatus in which said monitoring means is housed, said movable servicing apparatus being capable of monitoring at least part of said friction effect of at least one said spinning unit, and a removable housing part covering said wedge-shaped gap of each spinning unit, said servicing apparatus including insertable testing head means for measuring air flow in the area of said wedge-shaped gap upon removal of said housing part and insertion of said testing head means into said wedge-shaped gap.

45. Apparatus according to claim 44, wherein said suction insert means is equipped with control valve means, said servicing apparatus having actuating means for actuating said control valve means.

46. Open-end friction spinning apparatus comprising:

a plurality of spinning units, each of which contain a pair of adjacently arranged friction rollers forming a wedge-shaped yarn forming gap therebetween wherein yarn is formed from fibers by means of a friction effect at the surfaces of the rollers, at least one roller of each pair being equipped with suction insert means connected to a vacuum source, and friction effect monitoring means including coefficient of friction measuring means for measuring the coefficient of friction of the surface of at least one of said rollers; said coefficient of friction measuring means including extendable rod means, friction wheel means rotatably mounted on said extendable rod means for contacting said roller surface, driving means for rotating said friction wheel means, spring means for forcing said friction wheel means into contact with the surface of at least one of the rollers, brake means for preventing rotation of at least one of the rollers, and torque measuring means for measuring the torque which must be supplied by said driving means to effect rotation of said at least one of the rollers after application of said brake means to said at least one of the rollers.

47. Apparatus according to claim 46, wherein stopping means are provided for stopping a spinning unit, said stopping means being actuated by signals received from said torque measuring means.

48. Apparatus according to claim 46, further comprising a movable servicing apparatus, said movable servicing apparatus being capable of actuating said coefficient of friction measuring means.

49. Open-end friction spinning apparatus comprising:

at least one spinning unit, each said spinning unit containing a first and second relatively movable friction surface means forming a yarn forming region wherein yarn is formed from fibers by means of a friction effect at the friction surface means, said friction effect being composed of suction effect and friction surface means surface coefficient of friction effect, friction effect monitoring means for directly monitoring said friction effect in the yarn forming region other than by measuring the condition of formed yarn, said monitoring means including means for directly monitoring at least one of the suction effect in the yarn formation zone and the friction surface means surface coefficient of friction effect for each of the first and second friction surface means separately, means for comparing said monitored friction effect of said first and second friction surface means to one another, and friction effect adjusting means for adjusting said friction effect, said adjusting means including means for adjusting at least one of the suction effect in the yarn formation zone and the friction surface means surface coefficient of friction effect, said adjusting means being responsive to a changed friction effect monitored by said monitoring means.

50. Open-end friction spinning apparatus comprising:

at least one spinning unit, each said spinning unit containing a first and second relatively movable friction surface means forming a yarn forming region wherein yarn is formed from fibers by means of a friction effect at the friction surface means, said friction effect being composed of suction effect and friction surface means surface coefficient of friction effect, friction effect monitoring means for directly monitoring said friction effect in the yarn forming region other than by measuring the condition of formed yarn, said monitoring means including means for directly monitoring at least one of the suction effect in the yarn formation zone and the friction surface means surface coefficient of friction effect for each of the first and second friction surface means separately, and friction effect adjusting means for adjusting said friction effect, said adjusting means including means for adjusting at least one of the suction effect in the yarn formation zone and the friction surface means surface coefficient of friction effect, said adjusting means being responsive to a changed friction effect monitored by said monitoring means.

51. Open-end friction spinning apparatus comprising:

at least one spinning unit, each said spinning unit containing first and second relatively movable friction surface means forming a yarn forming region wherein yarn is formed from fibers by means of a friction effect at the friction surface means, said friction effect being composed of suction effect and friction surface means surface coefficient of friction effect, friction effect monitoring means for monitoring the relative value of said friction effect at the first and second friction surface means other than by measuring the condition of the formed yarn, and friction effect adjusting means for adjusting said friction effect as a function of the relative value of the friction effect at the first and second friction surface means, said adjusting means including means for adjusting at least one of the suction effect in the yarn formation zone and the friction surface means surface coefficient of friction effect

* * * * *